United States Patent [19]

Wayland

[11] Patent Number: 4,553,007

[45] Date of Patent: Nov. 12, 1985

[54] ARC RESISTANT VAPOR CONDENSING SHIELD FOR VACUUM-TYPE CIRCUIT INTERRUPTER

[75] Inventor: Paul O. Wayland, Montour Falls, N.Y.

[73] Assignee: Westinghouse Electric Corp., Pittsburgh, Pa.

[21] Appl. No.: 537,997

[22] Filed: Sep. 30, 1983

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 4,020,304 | 4/1977 | Cherry | 200/144 B |
| 4,414,448 | 11/1983 | Kashimoto et al. | 200/144 B |
| 4,417,110 | 11/1983 | Yanagisawa et al. | 200/144 B |

*Primary Examiner*—Robert S. Macon

*Attorney, Agent, or Firm*—C. L. Menzemer

[57] ABSTRACT

A vacuum-type circuit interrupter is provided having a vapor condensing shield which at least in the arcing area is comprised of the same two metallic components as the separable metallic electrical contacts.

6 Claims, 3 Drawing Figures

ARC RESISTANT VAPOR CONDENSING SHIELD FOR VACUUM-TYPE CIRCUIT INTERRUPTER

BACKGROUND OF THE INVENTION

1. Field of the Invention

The present invention is in the field of vacuum-type circuit interrupters and is specifically concerned with the composition of the vapor condensing shield of the interrupter.

2. Description of the Prior Art

It is customary in vacuum-type circuit interrupters to provide a vapor condensing shield to prevent the outward dissemination of the arc and included metallic particles from damaging, or in the case of the metallic particles, from adhering to the outer insulating walls of the vacuum interrupter.

U.S. Pat. No. 4,020,304 entitled "Two-Material Vapor Shield for Vacuum-Type Circuit Interrupter" teaches a vacuum-type interrupter in which at least that part of the vapor condensing shield in the area of the arc consists of copper. The remainder of the shield may be copper or steel.

It is well known that the separable metallic electrical contacts may be constructed of a copper-chromium composition.

SUMMARY OF THE INVENTION

The present invention is directed to a vacuum-type circuit interrupter comprising in combination: means defining an evacuated envelope; a pair of two-component metallic separable electrical contacts disposed within the evacuated envelope, said contacts being separable to establish arcing; a vapor condensing shield disposed within said evacuated envelope to protect the envelope from (1) arc activity and (2) the deposition of metallic particles on said envelope, at least that portion of the vapor-condensing shield adjacent to said separable contacts and within the arcing area being comprised of the same two metallic components as the electrical contacts.

DESCRIPTION OF THE DRAWINGS

For a better understanding of the present invention reference should be had to the following detailed discussion and drawing in which.

DESCRIPTION OF THE PREFERRED EMBODIMENT

The construction of vacuum-type interrupters typically employ the combination of a separable set of contacts in conjunction with a single material vapor condensation shield. In some cases, the shield may be of one material in the arcing area and a second material comprising the remainder of the shield.

Typically, the contacts are formed of a powder metal blend of chromium plus copper and contain slots to cause the arc to rotate.

The shield is typically made from either copper or 300 series stainless steel, or the shield may be comprised of copper in the arcing area and the remainder of the shield may be of stainless steel.

The weakness of these prior art designs is that during operation, the rotating arc at the contacts tends to bow outward radially off the periphery of the contact set with associated high heat flux arriving at the vapor condensation shield adjacent to the contact gap, i.e., the arcing area.

In cases where arc attachment to the shield occurs, the high heat flux has been observed to destroy the integrity of simple one-piece shield materials such as copper or stainless steel in the arcing area.

An obvious solution to this problem is to increase the overall diameter of the device in order to provide more radial clearance between the contact set and the shield; however, the diameter of the device is strongly related to its costs and, therefore, it is desirable to fabricate the vacuum interrupter with a minimum diameter for a given interruption current rating.

Figure 1:
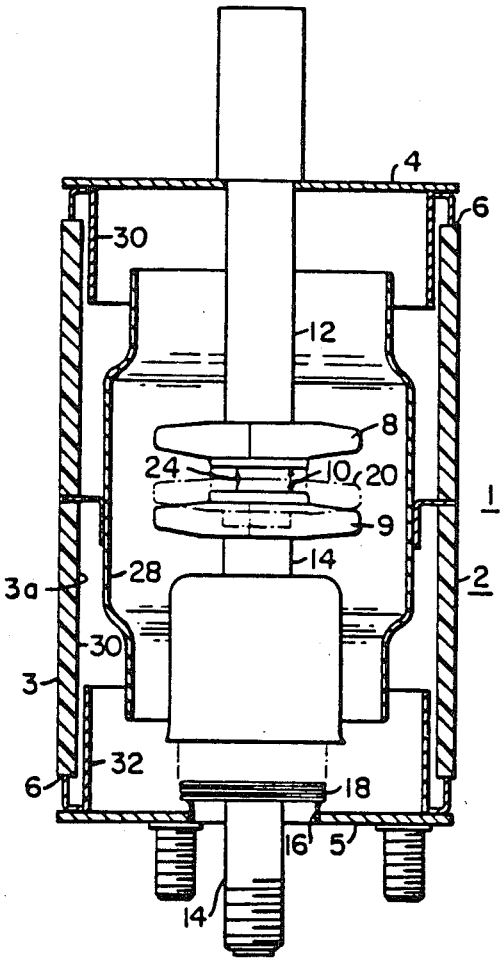
FIG. 1 is a vertical sectional view of a vacuum-type circuit interrupter embodying the principles of the present invention, the contacts being illustrated in the fully open circuit position.

Referring to the vacuum-type circuit interrupter of FIG. 1, generally designated by the reference numeral 1, there is shown a highly-evacuated envelope 2 comprising a casing 3 of suitable insulating material, and a pair of metallic end caps 4 and 5, closing off the ends of the case 2. Suitable seals 6 are provided between the end caps and the casing 2 to render the envelope vacuum-tight. The normal pressure within the envelope 2, under static conditions, is lower than $10^{-4}$ torr; so that reasonable assurance is had that the mean-free path for electrons will be longer than the potential breakdown paths within the envelope 2.

Located within the envelope 2 is a pair of relatively movable contacts, or electrodes 8 and 9, shown in full lines in FIG. 1 in their separated or open-circuit position.

The contacts or electrodes 8 and 9 are comprised of from 40% to 80%, by weight copper and from 60% to 20%, by weight, chromium.

When the contacts 8 and 9 are separated, there is an arcing gap 10 located therebetween. The upper contact 8 is a stationary contact suitably secured to a conductive rod, or stem 12, which at its upper end is united to the upper end cap 4. The lower contact 9 is a movable contact joined to a conductive operating rod, or stem 14, which is suitably mounted for movement. The operating rod 14 projects through an opening 16 in the lower end cap 5, and a flexible metallic bellows 18 provides a seal about the rod, or stem 14, to allow for movement of the rod without impairing the vacuum inside the envelope 2. As shown in FIG. 1, the bellows 18 is secured in sealing relationship at its respective opposite ends to the operating rod 14 and to the lower end cap 5.

Coupled to the lower end of the operating rod 14, suitable actuating means (not shown) are provided for driving the movable contact 9 upwardly into engagement with the stationary contact 8, so as to close the circuit through the interrupter 1. The closed position of the movable contact is indicated by the dotted lines 20. The actuating means is also capable of returning the contact 9 to its illustrated solid-line open position, so as to open the circuit through the interrupter 1. A circuit-opening operation will, for example, entail a typical gap length, when the contacts 8 and 9 are fully separated, of perhaps ½ inch.

The arc, indicated at 24, that is established across the gap 10 between the electrodes 8 and 9, as the electrodes are opened, and also when they are closed, vaporizes some of the contact material, and these vapors are dispersed from the arcing gap 10 toward the envelope 2. In the illustrated interrupter 1, the internal insulating surfaces 3*a* of the casing 3 are protected from the condensation of arc-generated metallic vapor and particles thereon by means of a tubular metallic shield 28 suitable supported upon the casing 3, and preferably isolated from both end caps 4 and 5. This shield 28 acts to intercept and to condense arc-generated metallic vapors before they can reach the casing 3. To reduce the chances of vapor bypassing the shield 28, a pair of end shields 30 and 32 are provided at opposite ends of the central shield 28.

The vapor shield 28 may be of either the floating type or the non-floating type.

I have discovered that an important improvement can be made in the performance of vapor shield 28 by making the vapor shield 28 of the same two metallic components as the contacts 8 and 9. That is, the vapor shield 28 is comprised of from 40% to 80%, by weight, copper and from 60% to 20%, by weight, chromium.

In the most preferred embodiment the percentage of chromium in the vapor shield is equal to or exceeds the percentage of chromium in the contact.

In the vacuum interrupter 1 of FIG. 1, the vapor shield 28 is shown constructed entirely of the copper-chromium material.

However, the ends of the vapor shield are in some cases origins of high field intensity, which may result in arcing in a vacuum. To avoid this type of arcing, a superior high-voltage material as, for example, a metal or alloy selected from the group consisting of stainless steel, nickel, copper and alloys and mixtures thereof may be used in conjunction with the copper-chromium material.

In such a case, the portion of the vapor shield adjacent to the separable contacts 8 and 9 or within the arcing area is of the copper-chromium material and the remainder of the vapor shield is of the high-voltage material.

Figure 2:
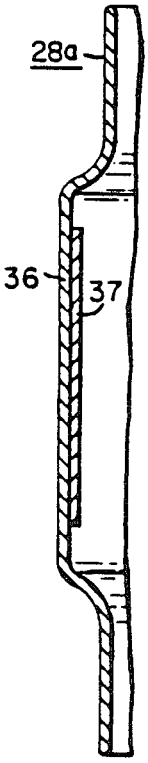
FIGS. 2 and 3 are partial sectional views of a vapor condensing shield showing ways of embodying the teachings of the present invention.

FIG. 2 illustrates a vapor shield in which end portions 28*a* consists of a high-voltage material as, for example, stainless steel 36 while copper-chromium material 37 is brazed to the stainless steel in the arcing area adjacent to the contacts 8 and 9.

Figure 3:
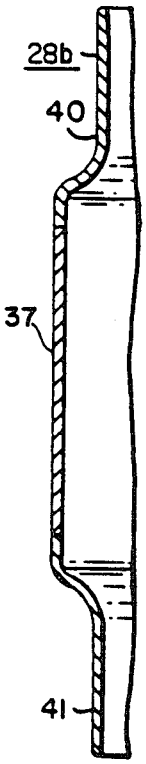

FIG. 3 illustrates another modified construction of the vapor shield 28 denoted as 28*b* in which the copper-chromium material 37 set forth above constitutes the central portion of the vapor shield and stainless steel or some other high-voltage material is used for the end portions 40 and 41.

I claim as my invention:

1. A vacuum-type circuit interrupter including in combination:

(a) means defining an evacuated envelope;

(b) a pair of two-component metallic electrical contacts disposed within the evacuated envelope, said contacts being separable to establish arcing;

(c) a vapor condensing shield disposed within said evacuated envelope to prevent the deposition of metal particles, emitting from the arcing region, on the envelope and to prevent heat flux from damaging the envelope; and (d) at least that portion of the vapor condensing shield adjacent to said separable contacts and within the arcing area being comprised of the same two metallic components as the separable electrical contacts.

2. The vacuum-type circuit interrupter of claim 1 in which the entire vapor condensing shield is comprised of the same two metallic components as the separable electrical contacts.

3. The vacuum-type circuit interrupter of claim 1 in which the remainder of the vapor condensing shield is comprised of a material selected from the group consisting of steel, nickel, copper and alloys and mixtures thereof.

4. The vacuum-type circuit interrupter of claim 1 in which the two metallic components comprising the separable contacts and at least that portion of the vapor condensing shield adjacent to the contacts and in the arcing area are copper and chromium.

5. The vacuum-type circuit interrupter of claim 4 in which the separable contacts and at least that portion of the vapor condensing shield adjacent to the contacts and in the arcing area are comprised of, by weight, 40% to 80% copper and 60% to 20% chromium.

6. The vacuum-type circuit interrupter of claim 5 in which the percentage of chromium in the vapor shield is greater than the percentage of chromium in the contact.

* * * * *